US011661795B2

(12) United States Patent
Wang et al.

(10) Patent No.: US 11,661,795 B2
(45) Date of Patent: May 30, 2023

(54) TRIPPING OPTIMIZATION

(71) Applicant: ExxonMobil Technology and Engineering Company, Spring, TX (US)

(72) Inventors: Lei Wang, The Woodlands, TX (US); Melissa M. Lee, The Woodlands, TX (US); Jonathan B. Barry, The Woodlands, TX (US); Paul E. Pastusek, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 235 days.

(21) Appl. No.: 16/939,103

(22) Filed: Jul. 27, 2020

(65) Prior Publication Data

US 2021/0062584 A1 Mar. 4, 2021

Related U.S. Application Data

(60) Provisional application No. 62/895,175, filed on Sep. 3, 2019.

(51) Int. Cl.

| | |
|---|---|
| ***E21B 3/02*** | (2006.01) |
| ***E21B 19/16*** | (2006.01) |
| ***E21B 19/14*** | (2006.01) |
| ***E21B 44/00*** | (2006.01) |
| ***E21B 19/20*** | (2006.01) |
| ***E21B 44/02*** | (2006.01) |

(52) U.S. Cl.

CPC ..... *E21B 3/022* (2020.05); *E21B 19/14* (2013.01); *E21B 19/16* (2013.01); *E21B 44/00* (2013.01); *E21B 44/02* (2013.01); *E21B 19/161* (2013.01); *E21B 19/20* (2013.01)

(58) Field of Classification Search

CPC ..... E21B 3/022; E21B 19/14; E21B 19/16; E21B 44/00; E21B 44/02; E21B 19/161; E21B 19/20; E21B 19/00

See application file for complete search history.

(56) References Cited

U.S. PATENT DOCUMENTS

2015/0142318 A1* 5/2015 Hildebrand ..... E21B 19/00 702/9

2017/0058656 A1* 3/2017 Benson ..... E21B 44/00

(Continued)

*Primary Examiner* — Giovanna Wright
*Assistant Examiner* — Yanick A Akaragwe
(74) *Attorney, Agent, or Firm* — ExxonMobil Technology and Engineering Company—Law Department

(57) ABSTRACT

Methods and systems for optimizing timing for drilling and tripping operation. An example method may include receiving a plurality of sensor data characterizing rig equipment and tripping status. The method may include identifying a plurality of multi-thread rig states based on the plurality of sensor data. The method calculates a plurality of optimal rig state characteristics (RSCs), wherein the plurality of optimal RSCs are calculated based on the plurality of sensor data as it relates to the plurality of multi-thread rig states. The method also performs a tripping operation with the rig equipment after applying the plurality of optimal RSCs. The method may also gather a plurality of updated sensor data from the rig equipment during the tripping operation for a recalculation of the plurality of optimal RSCs.

30 Claims, 11 Drawing Sheets

200A

(56) References Cited

U.S. PATENT DOCUMENTS

| | | | | |
|---|---|---|---|---|
| 2019/0004882 | A1* | 1/2019 | Martin | G06F 11/006 |
| 2019/0032467 | A1 | 1/2019 | Wang et al. | |
| 2020/0088873 | A1* | 3/2020 | Blakely | G01S 17/89 |
| 2020/0199993 | A1* | 6/2020 | Friestad | E21B 41/00 |
| 2021/0016297 | A1* | 1/2021 | Birchfield | B01D 21/24 |

* cited by examiner

100

200A

200B

300

400

500A

500B

600A

600B

700A

700B

TRIPPING OPTIMIZATION

CROSS-REFERENCE TO RELATED APPLICATION

This application claims the benefit of U.S. Provisional Application 62/895,175 filed Sep. 3, 2019 entitled TRIPPING OPTIMIZATION, the entirety of which is incorporated by reference herein.

FIELD

The present techniques relate generally to systems and methods for controlling tripping for drilling operations. More particularly, the present disclosure relates to systems and methods that may be implemented to optimize tripping in and tripping out to reduce the total time of tripping.

BACKGROUND

The production of hydrocarbons, such as oil and gas, has been performed for many years. To produce these hydrocarbons, one or more wells in a field are drilled to a subsurface location which is generally referred to as a subterranean formation or basin. The process of producing hydrocarbons from the subsurface location typically involves various development phases from a concept selection phase to a production phase. One of the development phases involves the drilling operations that form a fluid conduit from the surface to the subsurface location. The drilling operations may involve using different equipment, such as hydraulic systems, drill pipe, drill bits, mud motors, pipe handlers, a top drive, an iron roughneck, and other components which are utilized to drill to a target depth. Tripping operation refers collectively to both tripping in, or the connection of and lowering of pipe into a wellbore, and tripping out, or the disconnection and removal of pipe from a wellbore.

SUMMARY

Methods and systems for optimizing timing for drilling and tripping operation. An example method may include receiving a number of sensor data characterizing rig equipment and tripping status. The method may include identifying a number of multi-thread rig states based on the number of sensor data. The method calculates a number of optimal rig state characteristics (RSCs), wherein the number of optimal RSCs are calculated based on the number of sensor data as it relates to the number of multi-thread rig states. The method also performs a tripping operation with the rig equipment after applying the number of optimal RSCs. The method may also gather a number of updated sensor data from the rig equipment during the tripping operation for a recalculation of the number of optimal RSCs.

Another embodiment provides a system for drilling a wellbore and or tripping a tubular string. The system includes a top drive, an iron roughneck, a pipe handler, and a control system. In an example, the control system is coupled to the top drive, iron roughneck, and pipe handler. The control system may include a processor and a storage medium including computer readable instructions. The instructions may be executed on the processor to receive a number of sensor data characterizing rig equipment and tripping status. The instructions may be executed on a processor to identify a number of multi-thread rig states based on the number of sensor data. The instructions may be executed on a processor to calculate a number of optimal rig state characteristics (RSCs), wherein the number of optimal RSCs are calculated based on the number of sensor data as it relates to the number of multi-thread rig states. The instructions may be executed on a processor to perform a tripping operation with the rig equipment after applying the number of optimal RSCs. The instructions may be executed on a processor to gather a number of updated sensor data from the rig equipment during the tripping operation for a recalculation of the number of optimal RSCs.

Another embodiment provides a non-transitory machine readable medium that includes instructions configured to direct a processor to receive data regarding a number of drilling parameters characterizing a drilling operation in a control system. The instructions may direct the processor to receive a number of sensor data characterizing rig equipment and tripping status. The instructions may be executed on a processor to identify a number of multi-thread rig states based on the number of sensor data. The instructions may be executed on a processor to calculate a number of optimal rig state characteristics (RSCs), wherein the number of optimal RSCs are calculated based on the number of sensor data as it relates to the number of multi-thread rig states. The instructions may be executed on a processor to perform a tripping operation with the rig equipment after applying the number of optimal RSCs. The instructions may be executed on a processor to gather a number of updated sensor data from the rig equipment during the tripping operation for a recalculation of the number of optimal RSCs.

DESCRIPTION OF THE DRAWINGS

The advantages of the present techniques are better understood by referring to the following detailed description and the attached drawings, in which.

Figure 1:
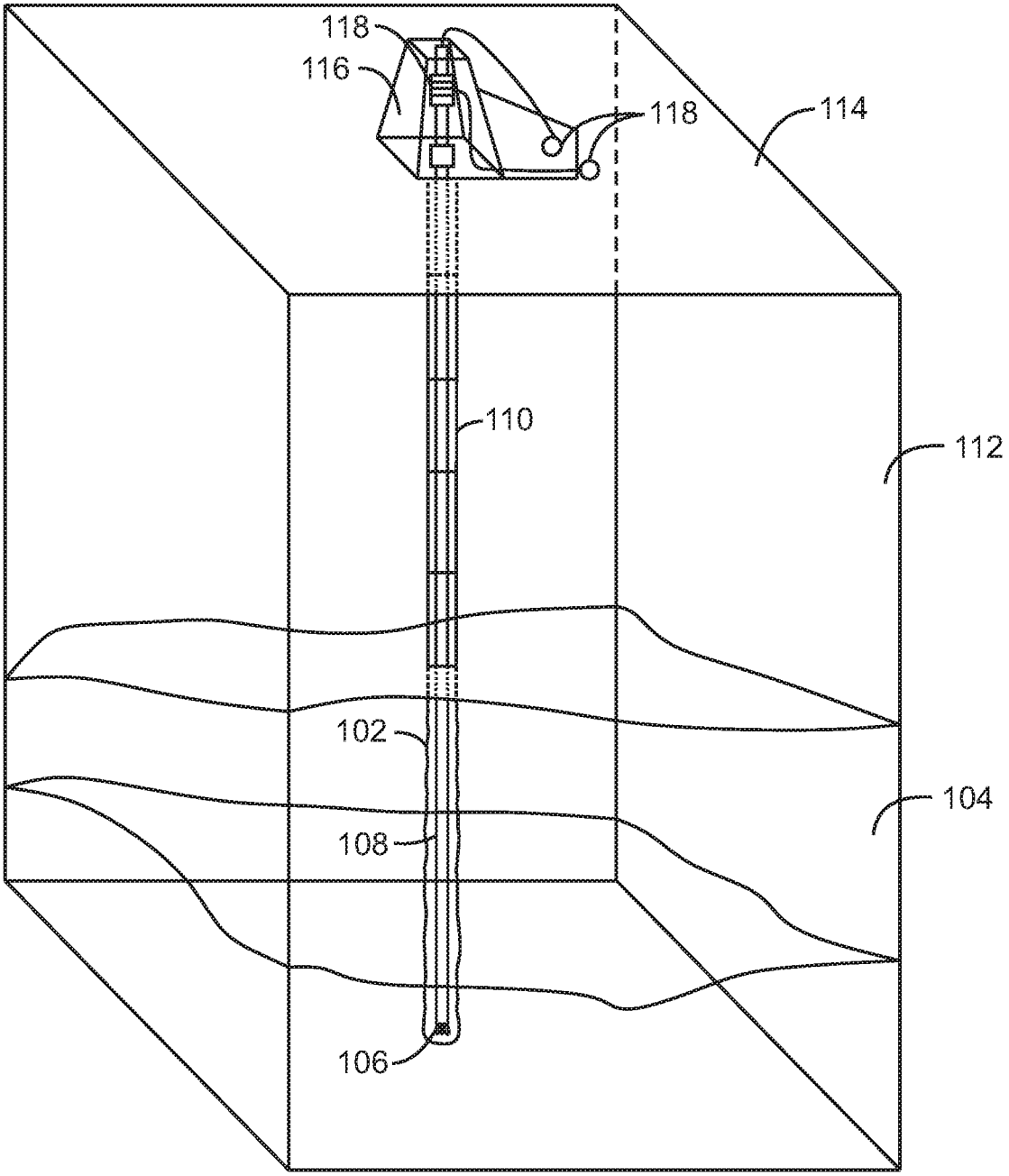
FIG. 1 is a drawing of a drilling operation for forming a wellbore to a subterranean formation, in accordance with examples.

For simplicity and clarity of illustration, elements shown in the drawings have not necessarily been drawn to scale. For example, the dimensions of some of the elements may be exaggerated relative to other elements for clarity. Further, where considered appropriate, reference numerals may be repeated among the drawings to indicate corresponding or analogous elements.

DETAILED DESCRIPTION

In the following detailed description, a number of the presently disclosed techniques are described in connection with exemplary embodiments. However, to the extent that the following description is specific to a particular embodiment or a particular use of the present techniques, this is intended to be for exemplary purposes only. Accordingly, the present techniques are not limited to the specific embodiments described below, but rather, such techniques include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, "drawworks" refers to the machine on a rig consisting of a large-diameter steel spool, brakes, a power source and assorted auxiliary devices. The primary function of the drawworks is to reel out and reel in the drilling line, a large diameter wire rope, in a controlled fashion. The drilling line is reeled over the crown block and traveling block to gain mechanical advantage in a "block and tackle" or "pulley" fashion. This reeling out and in of the drilling line causes the traveling block, and whatever may be hanging underneath it, to be lowered into or raised out of the wellbore. The reeling out of the drilling line is powered by gravity and reeling in by an electric motor or diesel engine.

As used herein, a "fingerboard" is a working platform approximately halfway up the derrick or mast in which the derrickman stores drillpipe and drill collars in an orderly fashion during trips in and out of the hole. The platform may consist of a small section from which the derrickman works called the monkeyboard, and several steel fingers with slots between them that keep the tops of the drillpipe in place.

As used herein, and "iron roughneck" is a piece of hydraulic machinery used to connect and disconnect segments of pipe in a modern drilling rig. The segments can be manipulated as they are hoisted into and out of a borehole.

As used herein, a "joint" refers to a single unitary length of pipe. As used herein, the term "joint" may include a length of pipe, usually referring to drillpipe, casing or tubing. While there are different standard lengths, the most common drillpipe joint length is around 30 ft. (9 m). For casing, the most common length of a joint is 40 ft. (12 m).

As used herein, a "pipe" refers to any tubular that carries pressurized gasses or liquids, such as a pipeline, a riser, a flow line, and a choke and kill line, for example. A pipe can also mean a conduit or duct operable to contain a fluid flow, and is not therefore limited to a cylindrical cross section conduit typically referred to as a pipe.

As used herein, a "pipe handler" refers to a mechanical device that moves or connects pipes to a drillstring. The pipe handler may include handling tools, such as a gripper or spinner-gripper. Once the pipe handler has moved the pipe from the fingerboard into position, the iron roughneck only has to connect the pipe. During removal, once the iron roughneck has disconnected the pipe, the pipe handler may move the pipe back to the fingerboard. While the term pipe is used, stands or joints or casing and similar tubulars may also be handled by the pipe handler.

As used herein, a "slip" may refer a device used to grip the drillstring in a relatively non-damaging manner and suspend it in the rotary table. This device may consists of three or more steel wedges that are hinged together, forming a near circle around the drillpipe. The slip may provide a compressive force on the drillpipe and effectively lock everything together. The rig crew can unscrew the upper portion of the drillstring (kelly, saver sub, a joint or stand of pipe) while the lower part is suspended and held in the slip. After some other component is screwed onto the lower part of the drillstring, the driller raises the drillstring to unlock the gripping action of the slips, and the rig crew removes the slips from the rotary. Reference to "slip off" accordingly indicates that the device is not engaged with the tubular i.e. the tubular string is free to move and a status of "slip on" refers to the device clamps the tubular i.e. the tubular string is not moveable.

As used herein, a "stand" refers to two or three single joints of drillpipe or drill collars that remain screwed together during tripping operations. Most modern medium- to deep-capacity drilling rigs handle three-joint stands, called trebles or triples. Some smaller rigs have the capacity for only two-joint stands, called doubles. In each case, the drillpipe or drill collars are stood back upright in the derrick and placed into fingerboards to keep them orderly. This is a relatively efficient way to remove the drillstring from the well when changing the bit or making adjustments to the bottomhole assembly, rather than unscrewing every threaded connection and laying the pipe down to a horizontal position.

As used herein, a "top drive" is device that turns the drillstring or other tubulars, as well as raising and lowering the tubulars with force generated by drawworks associated with the top drive. It consists of one or more motors (electric or hydraulic) connected with appropriate gearing to a short section of pipe called a quill that in turn may be screwed into a saver sub or the drillstring itself. The top drive is suspended from the hook that is held by a pulley system, so the rotary mechanism is free to travel up and down the derrick. This is radically different from the more conventional rotary table and Kelly method of turning the drillstring because it enables drilling to be done with three joint stands instead of single joints of pipe. It also enables the driller to quickly engage the pumps or the rotary while tripping pipe, which cannot be done easily with the Kelly system.

As used herein, "tripping in" to a well may be defined as the operation of lowering or running a tool into the well on a work string, such as a drill string or tubing string or casing string. A trip in includes lowering the tool on the work/drill string. A trip in may also refer to the process of assembling a tubing or drill string into a borehole or wellbore, incrementally, in approximately 90 ft. "stand" sections of pipe including three "joints" of about 30 ft. each.

As used herein, "tripping operation" refers collectively to both "tripping in" and "tripping out" actions. As used herein, tripping operation includes a number of components including a "top drive," "iron roughneck," and a "pipe handler."

As used herein, "tripping out" refers to raising and retrieving the tool on the work/drill string. A trip out may also refer to the process of dis-assembling a tubing or drill string from a borehole or wellbore, incrementally, in approximately 90 ft. "stand" sections of pipe including three "joints" of about 30 ft. each.

As used herein, "tripping" when used without further modifiers, may broadly refer to any of or one or more of tripping in, tripping out, either the full length of a tubular string or a partial length of a tubular string, such as tripping only one joint, several joints, or a whole string such as to inspect or replace a drill bit. Most often however, "tripping" refers to removal of or entry of a full drill string within a wellbore.

As used herein, a "tubular" means all forms of drill pipe, tubing, casing, drill collars, liners, and other tubulars for oilfield operations as are understood in the art. A tubular may also refer to a fluid conduit having an axial bore, and includes, but is not limited to, a riser, a casing, a production tubing, a liner, and any other type of wellbore tubular known to a person of ordinary skill in the art. In an example, a tubular refers to any structure that may be generally round, generally oval, or even generally elliptical. A tubular may also include any substantially flexible line, umbilical or a bundle thereof, that can include one or more hollow conduits for carrying fluids, hydraulic lines, electrical conductors or communications lines. These tubulars can also be collectively referred to as jumpers. The term tubular may be used in combination with joint to mean a single unitary length, or a stand meaning two or more interconnected joints.

Techniques described herein provide methods and systems for optimizing tripping during a well construction phase. The techniques include general tripping operations which in turn operating the following three pieces of rig equipment either in a sequential or partially overlapping order: top drive and draw works, iron roughneck, and a pipe handler. There may be a number of other components involved in tripping and may be a part of the techniques disclosed herein. For simplicity, much of the disclosure refers to the top drive, iron roughneck, and pipe handler as example rig equipment to be managed. As used herein, an iron roughneck is a mechanical device used for joining pipe segments.

Tripping includes a repetitive cycle of adding or removing pipe segments, such as joints or stands, as the pipe is moved into or out of a wellbore. Accordingly, tripping in includes using a pipe handler to move a joint or stand from a fingerboard towards the top drive which handles the pipe as it is attached to the wellbore by the iron roughneck, then lowered into the wellbore by the top drive. Similarly, tripping out removes a joint or stand from the wellbore with the top drive, disconnecting the joint or stand from the pipe that is still in the wellbore using the iron roughneck, and using the pipe handler to retrieve the joint or stand and return it to the fingerboard.

Compared to manual controls for initiating each step involving the top drive, iron roughneck, and pipe handler, automating these operations has resulted in more efficient and time optimized results. However, current automation has been performed only in the general control of each of the devices during the operations to connect and disconnect pipe segments, such as joints or stands, during the tripping operations independently of the other devices.

Techniques described herein optimize the control of each of the devices by allowing overlapping operations during periods in which the devices do not interfere with each other, decreasing the total amount of time to complete the pipe connection and disconnection operations during tripping. The results of the optimization are significant because the times savings are multiplied by how many times pipe segments are joined or disconnected during tripping, which is very frequent for longer wellbores. Automating control of this equipment can also be responsive to measured conditions at the surface which are more accessible than attempts to automate based on more remote, downhole operations.

For context, current automated operation of the tripping equipment may provide approximately six minutes per stand for tripping out and four minutes per stand for tripping in a drill pipe. In an example, for an offshore well profile with 5 km measured depth, the drill string may include over 165 stands, meaning that the tripping in cycle occurred more than 165 times that the equipment needed to form each new connection. Similarly, in this example, removal of the stands would likewise include the more than 165 actions to break each of these connections. In this example, reduction of even a minute or more per stand could save hours for installation or removal of an entire drill string. Use of these techniques in longer wells could result in additional time savings.

Optimizing the tripping operations can include identifying each operation step and assigning a rig state to that step. Assignment of states to each operation enables the measurement of specific characteristics for each operation to be enabled to start. In an example, extending and retrieving the mechanical arm of the iron roughneck may be detected as two separate states from the surface sensor data. As described herein, there may be at least three pieces of equipment involved in the tripping operation, and the movements of each may overlap in time without interfering with each other. The movement of a piece of equipment may be part of a rig state for the piece of equipment. When there are multiple pieces of equipment moving at the same time, the system as a whole could thereby have multiple rig states coexisting at a certain time instance. For a tripping in example, once the pipe is lowered into the well, the slip in the rig floor engages to hold the pipe. The top drive then releases and moves up and/or out of the way. The iron roughneck can move in along with the pipe handler to join a new stand to the pipe in the well. The top drive engages the new stand after it is joined. The iron roughneck and pipe handler move out of the way. The slip in the rig floor releases, and the top drive can lower the pipe, with the newly attached stand, into the wellbore. While the action for each of these equipment states may have previously been done one at a time, in the present techniques, equipment action may overlap in whole or in part based on a number of rig state characteristics. Rather than executing only a single action at a time via a single state for a rig during a time instance, multiple states may co-exist, and their overlap may be referred to as the multi-threading of rig states.

In order to enable the successful implementation of multi-threading rig states, state detection for multiple states and equipment may be used. These detections may sense different data points about the equipment, such as the location of the equipment, the time the equipment starts an action, the speed of travel of the equipment, a time when an action is completed by the equipment, and many more similar data points. After detecting the rig states, the tripping operation may be assessed by quantifying the duration of each step and time gaps between any two states. With a scheduling optimization algorithm, tripping operations may be optimized and automated. Detection of rig states detection may also enable a device to quantify tripping operation and compare drilling contractor companies in the tender phase for rig evaluation.

Once rig states are identified for quantification and measurement, optimizing the tripping operations during a single cycle becomes a scheduling optimization problem. By measuring time between steps and analyzing when equipment can be moving at the same time without impacting task completion, a controller can then minimize gaps between same-thread states or cross-thread states to minimize the total tripping time and enhance operation consistency.

The present techniques disclose data collection, multi-thread rig state detection, rig state characterization, and scheduling optimization. Further details for data collection are discussed with respect to FIG. 5A and FIG. 5B. In addition, details for multi-thread rig state detection are discussed with respect to FIGS. 2A and 2B with FIG. 6A, FIG. 6B, FIG. 7A, and FIG. 7B showing some particular examples. The scheduling optimization is further discussed below with respect to FIG. 4.

FIG. 1 is a drawing of a drilling operation 100 for forming a wellbore 102 to a subterranean formation 104. The drilling operation 100 is conducted by a drill bit 106 that is attached to a drill string 108. The drill bit 106 can be unpowered, using rotation of the drill string 108 at the surface to power the drilling operation 100. In some embodiments, the drill bit 106 can include a mud motor that is powered by fluid flow through the drill string 108. Casing segments 110 are generally installed along the wellbore 102 after drilling, for example, through the overburden 112.

At the surface 114, a drilling rig 116 is used to suspend the drill string 108 and drill bit 106. Rig equipment 118 on the drilling rig 116 is used to rotate the drill string 108, pump fluids through the drill string 108, and measure drilling parameters, such as the weight-on-bit (WOB), rotation rates (RPM), pressures, torques, bit position, and the like. This equipment can include a top drive, iron roughneck, and pipe handler and is discussed further with respect to FIG. 3. Tripping occurs at the surface 114 when the drill string 108 is tripped in or out of the wellbore.

Figure 2A:
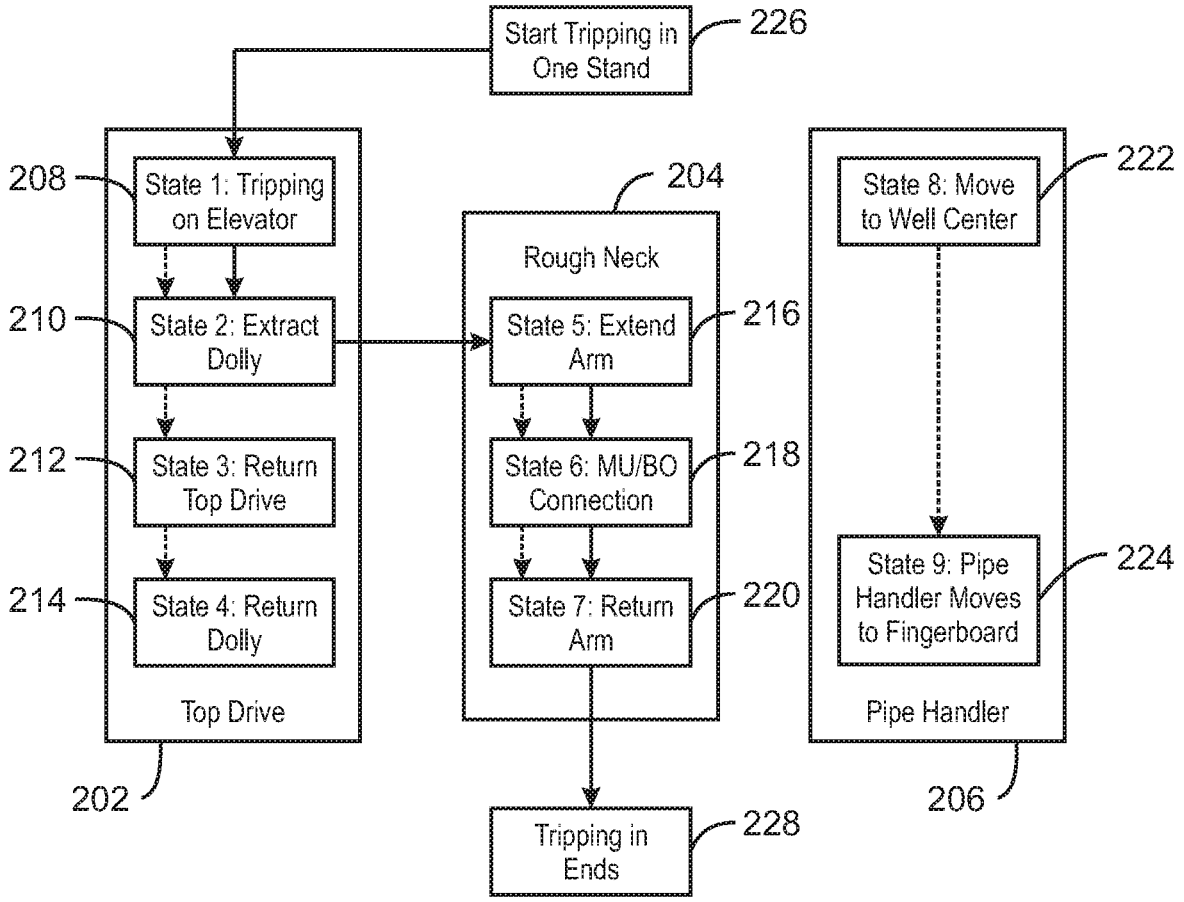
FIGS. 2A and 2B are schematic drawings of tripping cycles showing the sequence of equipment steps that optimize tripping in and tripping out, in accordance with examples.

FIG. 2A is a schematic of a tripping in operation cycle 200A showing the sequence of equipment steps that optimize the tripping in operation, in accordance with an example. A tripping operation cycle, such as tripping in, can include additional components and operation not shown in this figure, however the presently shown components are used to illustrate an example of the techniques disclosed.

The tripping in operation cycle 200A can include actions undertaken by rig equipment including a top drive 202, an iron roughneck 204, and a pipe handler 206. In an example, the start and stop of each action undertaken by this rig equipment are considered to respectively mark the beginning and end of a discrete state to be associated with this equipment. In an example, the usage statistics or rig equipment characteristics for each of these states can be measured for each stand that is tripped in or tripped out. This repeated data gathering enables analysis and optimization that can control the timing of each of these states. In an example, controlling the timing of each of these states can include overlapping the states so that more than one piece of rig equipment may be in motion at the same time. When multiple pieces or rig equipment are in motion at the same time, these states may be thought of as being multi-threaded because multiple states are being enacted at the same time by different components each according to their own conditions to begin.

In an example, the sequence of states in a top drive 202 can begin with a state #1 208 which includes tripping in a stand on an elevator of a top drive. The moving top drive 202 enables the positioning of a drill pipe attached to the elevator for further tripping in to occur. Block height decreases during tripping in and increases during tripping out. In state #2 210, the top drive 202 is removed from the well center and into a retracted position. In state #3 212, top drive 202 is returned to a latching position for the next stand to be attached. Block height moves to the high position during tripping in and low position during tripping out. In state #4 214, the top drive 202 is extended to the well center.

The states for an iron roughneck 204 can execute at the same time as other components when initial conditions are met. For example, state #5 216 includes the iron roughneck 204 extending an arm towards the well center around the drill pipe. State #6 218 includes, for example, the making and breaking of connections by the iron roughneck 204 during tripping operations. In state #7 220, the iron roughneck 204 retracts its arm to the original position of the iron roughneck.

The states for a pipe handler 206 can overlap states for other components when initial conditions for the pipe handler 206 are met, e.g., when the overlapping motion will not result in contact between the components. For example, state #8 222 includes the pipe handler 206 carrying a new stand from a fingerboard to the well center during tripping in, and prepares and catches the existing stand during tripping out. In state #9 224, the pipe handler may prepare and grab a new stand from the fingerboard while the top drive 202 is tripping in pipe, and the pipe handler 206 may carry and rack the existing stand to the fingerboard while the top drive 202 is tripping out pipe.

By using these distinct states and identifying the states in relation to the rig equipment each state is involved in controlling, data can be gathered with sufficient granularity for efficient analysis and optimization. In an example, signals detected from sensors in the drilling system and on the tripping components can be gathered and organized so the data is segmented on a per stand or per joint basis. In an example, each stand or joint starts from the time stamp of a current slip-off until the next slip-off. After detected data is separated into segments for each stand, the rig states associated with the top drive, iron roughneck, and pipe handler can be generated or detected based on pattern recognition algorithms.

Since some steps of tripping in and tripping out are reciprocal, a common rig state may be used for the bidirectional operations. For example, instead of keeping two states of "tripping in on elevator" and "tripping out on elevator", the states can be defined as a single state of "tripping on elevator", and the tripping direction can be identified from the change in bit depth. This designation may also allow for twice the amount of data collection as tripping in data may be reversed on a time axis to yield usable data for tripping out operations.

Figure 2B:
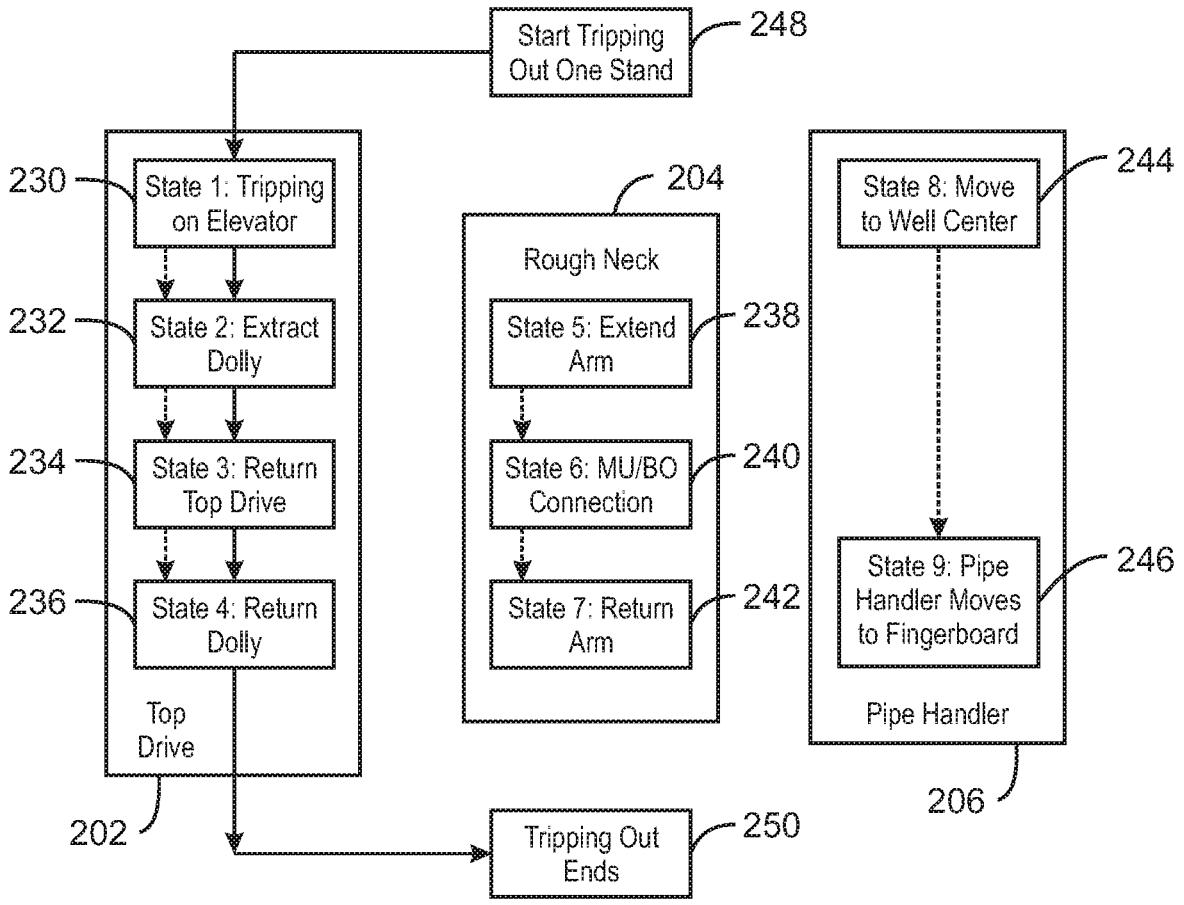

In both FIG. 2A and FIG. 2B dashed arrows are included between each of the states within a particular piece of rig equipment. These dashed arrows are shown to help visualize how each piece of equipment needs only complete a specific set of functions, where each function may have a number of characteristics associated with it. Some of those characteristics can include the average completion time for a particular state. For example, state #5 216 may start before state #1 208 is completed. These states may co-occur so long the pipe arrives in the proper position by the time the iron roughneck 204 begins taking action to couple or decouple the pipe. Additionally, these actions may be timed in order to minimize overall delays for the entire tripping cycle.

In order to expedite the tripping process, an objective function needs to be determined to convert the tripping operation into a mathematical optimization problem with a goal of minimizing the objective function. The objective function may be defined as the total time duration of a critical operation path which includes certain important states that determine the tripping cycle for each stand. In an example, the path can start where a single stand begins a tripping in cycle at item 226. In FIG. 2A, an example critical path is indicated by the solid black arrow. Thus the critical path for tripping in, in this example, includes states 1, 2, 5, 6, and 7 before the tripping in ends 228.

Using the detected and demarcated rig states, for various time instances, a number of characteristics associated with each state and the function of the equipment during the particular state. Rig State Characteristics (RSC) may include the duration of each rig state, starting time of each rig state, and time difference between any different rig states for each stand. With the RSC for each stand, quantitatively assessing tripping operation may be determined by using the statistics of the RSC for the overall tripping and/or multiple stands. For example, the statistics may include average, standard deviation, median, min, max, and more as seen in FIGS. 6A, 6B, 7A, and 7B.

FIG. 2B is a schematic of a tripping out operation cycle 200B showing the sequence of equipment steps that optimize the tripping out operation, in accordance with an example. A tripping operation cycle, such as tripping out, can include additional components and operation not shown in this figure, however the presently shown components are used to illustrate an example of the techniques disclosed. Like numbered items are as described with respect to FIG. 2A.

The tripping out operation cycle 200B can include actions undertaken by rig equipment including a top drive 202, an iron roughneck 204, and a pipe handler 206. As before, the start and stop of each action undertaken by rig equipment can have their timing controlled in order to optimize their start times. In an example, the timing of each of equipment state can include overlapping the states so that more than one piece of rig equipment may be in motion at the same time. As before, when multiple pieces or rig equipment are in motion at the same time, these states may be thought of as being multi-threaded because multiple states are being enacted at the same time by different components each according to their own conditions to begin.

In an example, the sequence of states in a top drive 202 can begin with a state #1 230 which includes tripping out a stand on an elevator of a top drive. The moving top drive 202 enables the positioning of a drill pipe attached to the elevator for further tripping out to occur. In state #2 232, the top drive 202 is removed from the well center and into a retracted position. In state #3 234, top drive 202 is returned to a latching position for the next stand to be removed and tripped out. Block height moves to a low position during tripping out. In state #4 236, the top drive 202 is extended to the well center.

The states for an iron roughneck 204 can execute at the same time as components of the top drive 202 and the pipe handler 206. For example, state #5 238 includes the iron roughneck 204 extending an arm towards the well center around the drill pipe. State #6 240 includes, for example, the breaking a connection of pipe with the iron roughneck 204 during tripping operations. In state #7 242, the iron roughneck 204 retracts its arm to the original position of the iron roughneck.

The states for a pipe handler 206 can overlap states and actions made by the top drive 202 and the iron roughneck 204. For example, state #8 244 includes the pipe handler 206 preparing and catching an existing stand during tripping out. In state #9 246, the pipe handler 206 may carry and rack the existing stand to the fingerboard while the top drive 202 is tripping out pipe.

FIG. 2B includes dashed arrows between each of the states within a particular piece of rig equipment to identify a critical operation path to be optimized. The critical operation path may be defined with an objective function that can be minimized in order to reduce the time of operation for that critical path. In FIG. 2B, the critical path includes states #1 230, state #2 232, state #3 234, and state #4 236. In an example, state #2 232 may start before state #8 244 is completed. These states may co-occur so long the pipe is removed to the proper position by the time the top drive 202 is ready to begin tripping out pipe again. In an example, the path can start where a single stand begins a tripping out cycle at item 248. In FIG. 2B, an example critical path is indicated by the solid black arrow. Thus the critical path for tripping in, in this example, includes states 1, 2, 3, and 4 before the tripping out ends 250.

Figure 3:
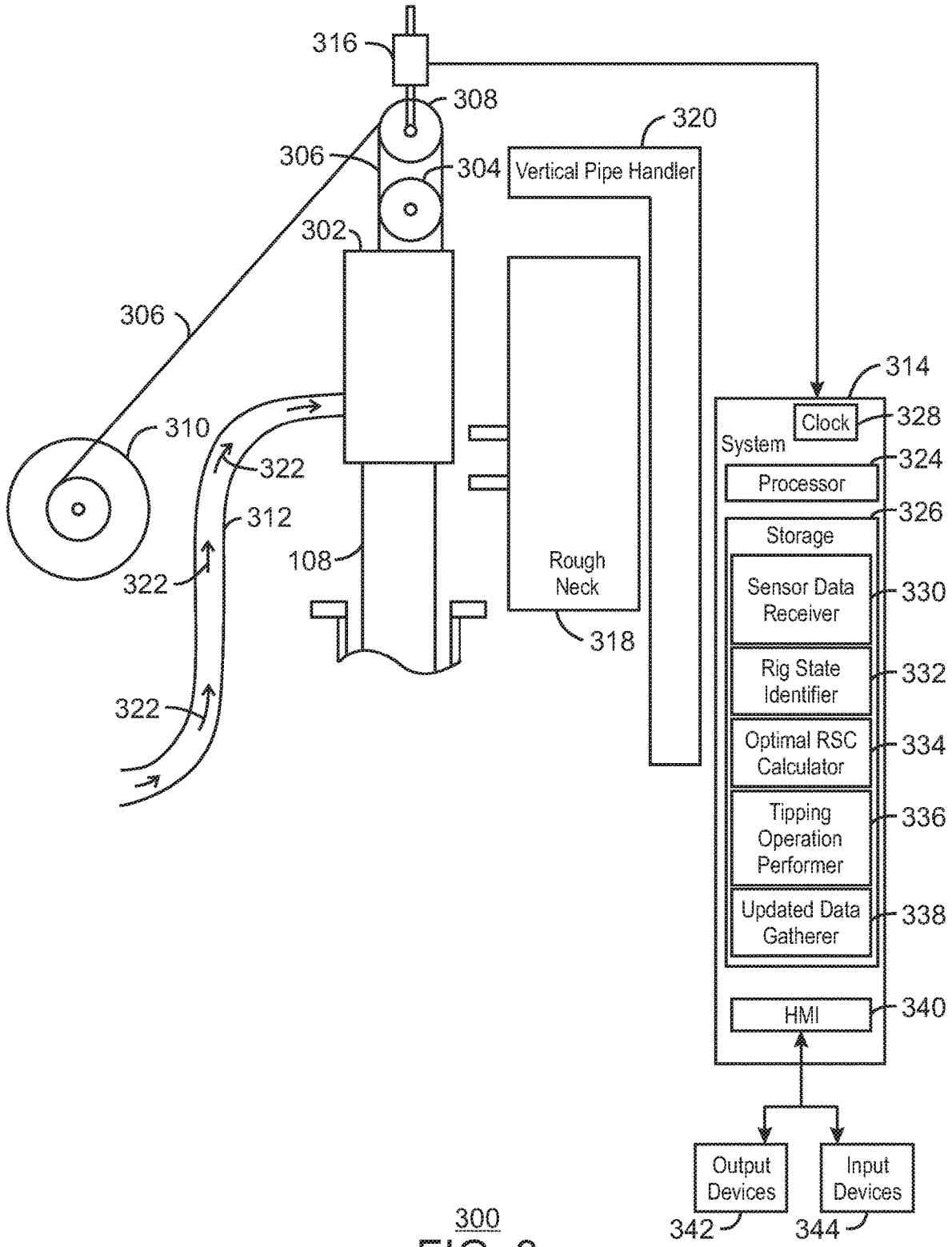
FIG. 3 is a schematic of surface equipment for a drilling rig operation, in accordance with an example.

FIG. 3 is a schematic of surface equipment for a drilling rig 300 operation. Like numbered items are as described with respect to FIG. 1. It can be understood that not all of the parts of the drilling rig 300 are shown, nor are the parts shown in the precise positions they would be on the drilling rig 300. Further, different parts may be used in place of some of the parts shown. For example, as shown in FIG. 3, the drill string 108 is rotated by a top drive 302, but a Kelly drive and rotary table may be used instead of or in addition to the top drive 302. The top drive 302 is suspended from a travelling block 304 by a drill line 306. A crown block 308 is used with the travelling block 304 to raise and lower the top drive 302 and the attached drill string 108. The drill line 306 is reeled in or out from a draw-works 310, powered by a motor (not shown). Drilling mud 322, or other drilling fluid, is pumped to the top drive 302 through a Kelly hose 312.

Any number of sensors may be used on the drilling rig 300 to determine various drilling parameters during a drilling operation. The drilling parameters can then be provided to a computing system 314 that uses the parameters to implement the techniques described herein. These sensors can include a strain gauge 316 that is incorporated into the support of the crown block 308. The computing system 314 may be a standalone computer, a part of a distributed control system (DCS), a programmable logic controller (PLC), or any number of other systems.

The rig equipment 118 can include an iron roughneck 318. As described herein, an iron roughneck 318 is a piece of hydraulic machinery used to handle segments of pipe in a modern drilling rig. The iron roughneck 318 may connect and disconnect the pipe segments, such as single pipe segments termed joints, or multiple pipe segments termed stands. The pipe segments can be manipulated to allow them to be hoisted, or tripped, into and out of a wellbore.

The rig equipment 118 can include a pipe handler 320, such as a vertical pipe handler. The pipe handler 320 may move pipe or stands which each include a number of connected pipe segments from a fingerboard that is holding the pipe or stand into position in-line with the drill string 108. The top drive 302 may hold the drill string while the pipe handler 320 holds the pipe in place against the drill string 108 and the iron roughneck 318 may connect the newly moved pipe to the drill string 108. In an example, a worker may place a connector joining the drill string 108 held by the top drive 302 and the pipe moved into place by the pipe handler 320. In an example, the iron roughneck 318 or other piece of rig equipment can be used to connect the pipe to the drill string 108. After the pipe is connected to the drill string 108, the top drive 302 may lower the drill string 108 further into the wellbore 102. This process is called tripping in as pipe or stands are attached to the drill string 108 and lowered into the wellbore 102.

Once connected, a drilling operation may occur where fresh drilling mud 322 is flowed through the drill string 108 to the drill bit 106, and out through nozzles in the drill bit 106. Tripping out is the reverse of the tripping in process, described herein. The top drive 302 can lift the drill string 108 from the wellbore 102 so that a pipe or a stand may be decoupled from the drill string 108. The decoupling may be handled by the iron roughneck 318 and may or may not involve a human worker detaching connection components.

The pipe handler 320 may hold the pipe or stand being detached from the drill string 108 as the pipe or stand is being detached. Once detached, the pipe or stand can be moved from a location over the wellbore 102 towards a fingerboard by the pipe handler 320. This process is referred to as a tripping out operation as it involves removing the pipe from the wellbore 102.

The drilling rig 300 can include operation and control enabled by the use of a processor 324 and storage 326. The processor 324 can be a single core processor, a multi-core processor, a virtual processor in a cloud computing system, an application specific integrated circuit (ASIC), or any number of other units. The storage 326 can include random access memory (RAM), read only memory (ROM), hard drives, optical drives, RAM drives, virtual drives in a cloud computing configuration, or any number of other storage systems. The storage 326 can hold the code and data blocks used to implement the methods, including a code for optimizing tripping in or tripping out.

The storage 326 may include instructions that when executed on the processor 324 enable a clock 328 that can be used in associating sensor data with a specific time when sensor data is received by the sensor data receiver 330. In an example, the sensor data receiver 330 is receiving a number of sensor data characterizing rig equipment and tripping status.

As shown in the FIG. 2, the time instance generated may be used in identifying the rig state at the rig state identifier 332. The computing 326 can be used to generate a discrete time instance using the clock 328 that enables the drilling rig 300 to be associated with a time and a current rig state. In an example, the rig state identifier 330 identifies a number of multi-thread rig states based on the number of sensor data.

The storage 326 may include instructions that when executed on the processor 324 enable optimal rig state characteristics (RSCs) calculator 334 to calculating a number of optimal rig state characteristics (RSCs), wherein the number of optimal RSCs are calculated based on the number of sensor data as it relates to the number of multi-thread rig states. The storage 326 may include instructions that when executed on the processor 324 enable the tripping operation performer 336 to perform a tripping operation with the rig equipment after applying the number of optimal RSCs. The storage 326 may include instructions that when executed on the processor 324 enable the updated data gatherer 338 to gather a number of updated sensor data from the rig equipment during the tripping operation for a recalculation of the number of optimal RSCs.

An HMI 340 provides an interface between the computing system 314 and various output devices 342 and input devices 344. The HMI 340 may be used to directly control the drilling rig 300 equipment or to observe a status of the equipment to spot any potential issues or provide oversight redundancy. The HMI 340 may accept input from a human worker through an input device 344. The HMI 340 may also provide readings or assessment through the HMI 340 through output devices 342. The output device 342 may provide output that is human readable to an output display. The output device 342 may provide output to another device that may read the results of the computer system 314 in order to analyze and provide guidance on the output. An example of potential analysis is seen with respect to FIGS. 6A, 6B, 7A, and 7B. Additional monitoring output to oversee the progress of a drilling system can be output to an output device 342 such as the output seen in FIG. 5A and FIG. 5B.

It can be noted that the techniques described herein are not limited to optimization of fully automated processes. Each of these states and steps may be completely automated or only partially automated. In an example, an operator may be prompted on the HMI 340 when a task may enter a next phase or state. In this example, the optimization calculations are used to determine the optimum overlapping times to initiate each manual process, and to instruct the operator to activate each of the processes, while keeping the individual pieces of equipment from contacting each other.

The input devices 344 can include keyboards and pointing devices used to provide input and configuration data to the computing system 314. The output devices 342 can include a display, an audible tone generator, an electronic mail interface, or a phone interface, or any combinations thereof. Accordingly, warnings can be communicated to a user as a screen change, a tone, a pager signal, a text message, an e-mail, or as any other types of communications. The computing system 314 may implement the method described herein, for example, with respect to FIG. 2 and FIG. 4.

FIG. 3 shows a rig floor during tripping or drilling operation. The top drive travels up and down with a stand of drill pipe (typically, three joints, 90 ft long total) attached to the elevator. The iron roughneck extends out to make up or break out the connection between two pipes and then retracts. The vertical pipe handler transports either a new stand from the fingerboard (pipe storage location) to the well center during tripping in or an existing stand from the well center to the fingerboard during tripping out.

Figure 4:
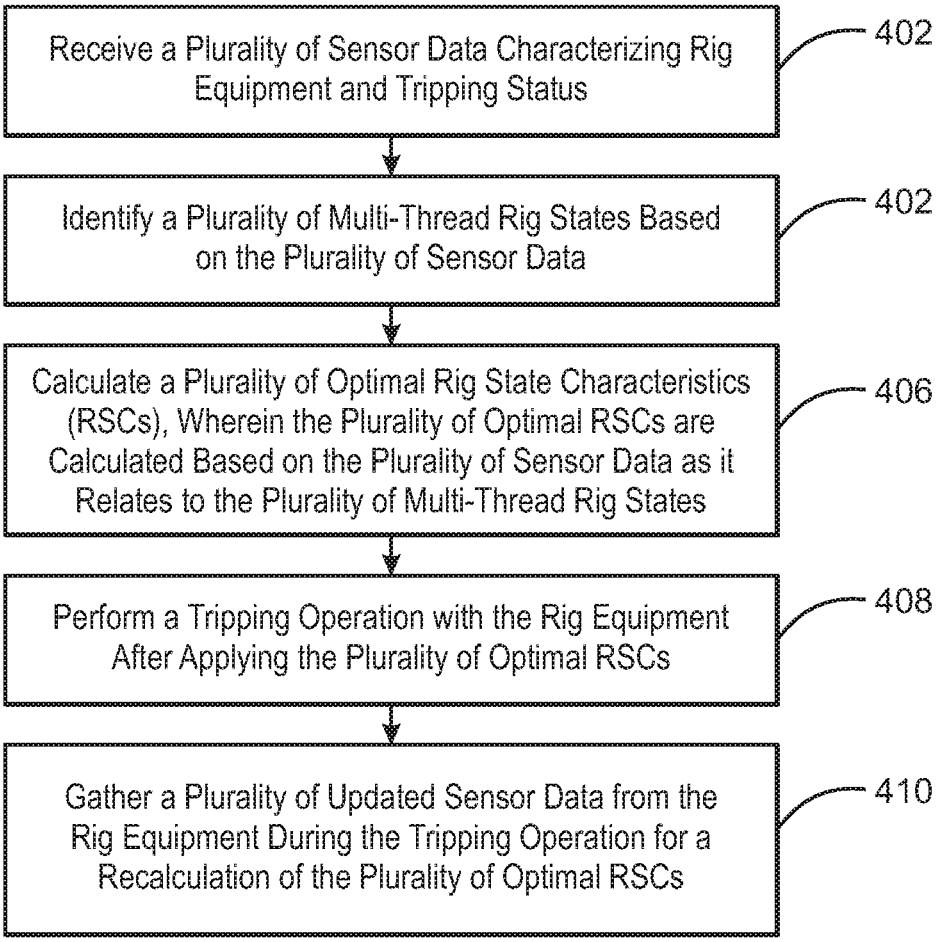
FIG. 4 is a process flow diagram of a method for optimizing tripping during a well completion phase, in accordance with an example.

FIG. 4 is a process flow diagram of a method 400 for optimizing tripping operation during a well completion operation. The method 400 may be implemented with a variety of hardware such as the equipment described with respect to FIG. 1 and FIG. 3.

At block 402, the method 400 includes receiving a number of sensor data characterizing rig equipment and tripping status. At block 404, the method 400 includes identifying a number of multi-thread rig states based on the number of sensor data. At block 406, the method 400 includes calculating a number of optimal rig state characteristics (RSCs), wherein the number of optimal RSCs are calculated based on the number of sensor data as it relates to the number of multi-thread rig states. In an example, identifying the optimal RSCs is based on historical locally generated sensor data for the rig equipment being optimized. The number of optimal RSCs may be selected by at least one of a conditional-based table or a machine learning algorithm. In an example, the number of optimal RSCs includes at least one of an optimal duration of each potential next rig state, an optimal starting time of each potential next rig state, and an optimal time difference between any different of each potential next rig state for each stand.

When calculating the number of optimal RSCs, the method 400 may use aggregated statistics relating to the number of sensor data measured for a number of stands tripped in using the rig equipment. In this example, wherein the aggregated statistics include at least one of an average, standard deviation, variance, median, min, max, percentile, quintile, or histogram based on the number of sensor data for the number of stands tripped in using the rig equipment.

In an example, calculating the number of optimal RSCs includes minimizing an objective function corresponding to a critical path identified from a subset of the number of multi-thread rig states. This example may further include selection of the critical path based on at least one function executed by a top drive for tripping that is tripping out, or the critical path is based on at least one function executed by an iron roughneck for tripping in. Indeed, identifying a critical path may include solving a scheduling optimization problem subject to constraints. These constraints may be a time dependency of at least two of the number of multi-thread rig states, where each of the number of multi-thread rig states corresponds to a different piece of rig equipment.

At block 408, the method 400 includes performing a tripping operation with the rig equipment after applying the number of optimal RSCs. In an example, performing a tripping operation with the rig equipment includes rig equipment that handles a tubular that includes at least one of a drill string, casing, a completion assembly, or a standalone screen. At block 410, the method 400 includes gathering a number of updated sensor data from the rig equipment during the tripping operation for a recalculation of the number of optimal RSCs. This recalculation may be repeated as needed after certain amounts of time or after a certain depth has been reached.

The optimization of the tripping operation can make use of a number of different optimization methods and equations. In an example, once the rig equipment states are determined and measured, analysis of the states is performed by scheduling optimization. The scheduling optimization may attempt to configure the beginning time of each state to decrease the total tripping time. A first approach is to reduce time where none of the components is moving, i.e. a waiting-for-nothing time. This type of reduction can reduce the waiting time for all types of rig equipment for each stand that is tripped in or tripped out.

In an example, the optimal solution can be calculated using a matrix to account for a large number of rig factors. When a tripping operation begins, e.g. item 226 in FIG. 2, the nine states discussed in FIG. 2 can have data accounted for in the following RSC matrix shown in Eqn. 1:

$$T = \begin{bmatrix} t_{00} & t_{01} & \cdots & t_{08} & t_{09} \\ t_{10} & t_{11} & \cdots & t_{18} & t_{19} \\ \vdots & \vdots & \ddots & \vdots & \vdots \\ t_{80} & t_{81} & \cdots & t_{88} & t_{89} \\ t_{90} & t_{91} & \cdots & t_{98} & t_{99} \end{bmatrix}_{10\times 10} \tag{1}$$

In Eqn. 1, $t_{ii}$ is the duration of the ith rig state, and $t_{ij}$ is the time difference from the beginning time of the ith rig state to the beginning time of the jth rig state, such that the formula shown in Eqn. 2 is true.

$$t_{ij} = \begin{cases} -t_{ji}, \text{ when } i \neq j \\ t_{ji} = t_{ii}, \text{ when } i = j \end{cases} \tag{2}$$

In Eqn. 2, $t_{ii}$ is a non-negative known value, which may be measured from the historical data, typically determined by equipment limit or physical-based model. For instance, the duration of return top drive is limited by the draw works speed, and the shortest duration of tripping on elevator is determine by the wellbore Surge and Swab model. In this example, $t_{ij}$ is a real number (positive or negative) and can be configurable. Assuming $\delta_{01}=\delta_{10}=0$, the only unknowns are $\delta_{05}$, $\delta_{08}$, $\delta_{12}$, $\delta_{23}$, $\delta_{34}$, $\delta_{56}$, $\delta_{67}$, and $\delta_{89}$, where $\delta_{ij}$ is the time difference from the ending time of ith state to the beginning time of jth state. In the other word, $\delta_{ij}$ may be positive if the rig states associated with the same machine due to serial steps, for instance $\delta_{12}>0$, $\delta_{23}>0$. In another example, the $\delta_{ij}$ may be either positive or negative for the rig states associated with different machines: $\delta_{ij}>0$ if the jth state does not start until the ith state finishes; $\delta_{ij}<0$ if the jth state may start before the ith state completes. Other $t_{ij}$ can be expressed with $\delta_{ij}$ and $t_{ii}$, as seen in the example equations Eqn. 3 and Eqn. 4.

$$t_{72}=(\delta_{05}+t_{55}+\delta_{56}+t_{66}+\delta_{67})-(t_{11}+\delta_{12}) \tag{3}$$

$$t_{27}=-t_{72}=(t_{11}+\delta_{21})-(\delta_{05}+t_{55}+\delta_{56}+t_{66}+\delta_{67}) \tag{4}$$

The $\text{Obj}_{out}$ below represents the critical path of tripping out operations. For tripping out, the critical path is defined by the top drive, as the next stand cannot be started until the top drive returns to its low position and its dolly is fully returned. Therefore, for a tripping out operation, the scheduling optimization problem may be expressed using the following process and logic:

1) Given a set of rig state durations $t_{ii}$, where i=1, . . . , 9
2) Find $\delta_{05}$, $\delta_{08}$, $\delta_{12}$, $\delta_{23}$, $\delta_{34}$, $\delta_{56}$, $\delta_{67}$, and $\delta_{89}$ to minimize the objective function seen in Eqn. 5.

$$\text{Obj}_{out}=t_{11}+\delta_{12}+t_{22}+\delta_{23}+t_{33}+\delta_{34}+t_{44} \tag{5}$$

3) The objective function of step 2 to be minimized subject to the following conditions:

$$\text{predefined value} > \delta_{05} > 0$$

$$\text{predefined value} > \delta_{08} > 0$$

$$\text{predefined value} > \delta_{12} > 0$$

$$\text{predefined value} > \delta_{23} > 0$$

$$\text{predefined value} > \delta_{34} > 0$$

$$\text{predefined value} > \delta_{56} > 0$$

$$\text{predefined value} > \delta_{67} > 0$$

$$\text{predefined value} > \delta_{89} > 0$$

$$t_{01} < t_{02} < t_{03} < t_{04}$$

$$t_{05} < t_{06} < t_{07}$$

$$t_{08} < t_{09}$$

$$\delta_{05} \geq t_{11}$$

(not move rough neck until tripping on elevator is done)

$$t_{11} + \delta_{12} \geq \delta_{05} + t_{55} + \delta_{56} + t_{66}$$

(not extract top drive dolly until connection break out is done)

$t_{69} \geq t_{66}$(pipe handler moves pipe to fingerboard right after break out connection)

$$t_{11} + \delta_{12} \geq \delta_{08} + t_{88} + \delta_{89}$$

$$\left(\begin{array}{l}\text{not move pipe handler to fingerboard} \\ \text{until top drive Dolly starts retracting}\end{array}\right)$$

Following the same logic, one may find that the critical path of tripping in is only determined by the iron roughneck. In other words, the top drive cannot start lowering its elevator until the iron roughneck returns to its original location. For a tripping in operation, the scheduling optimization problem may be expressed using the following process and logic:

1) Given a set of rig state durations $t_{ii}$, where i=1, . . . , 9
2) Find $\delta_{05}$, $\delta_{08}$, $\delta_{12}$, $\delta_{23}$, $\delta_{34}$, $\delta_{56}$, $\delta_{67}$, and $\delta_{89}$ to minimize the objective function seen in Eqn. 6

$$\text{Obj}_{in}=\delta_{05}+t_{55}+\delta_{65}+t_{66}+\delta_{76}+t_{77} \tag{6}$$

3) Where the objective function is subject to the following conditions:

$$\text{predefined value} > \delta_{05} > 0$$

$$\text{predefined value} > \delta_{08} > 0$$

$$\text{predefined value} > \delta_{12} > 0$$

$$\text{predefined value} > \delta_{23} > 0$$

$$\text{predefined value} > \delta_{34} > 0$$

$$\text{predefined value} > \delta_{56} > 0$$

$$\text{predefined value} > \delta_{67} > 0$$

$$\text{predefined value} > \delta_{89} > 0$$

$$t_{01} < t_{02} < t_{03} < t_{04}$$

$$t_{05} < t_{06} < t_{07}$$

$$t_{08} < t_{09}$$

$$\delta_{05} \geq t_{11}$$

(not move rough neck until tripping on elevator is done)

$$t_{11} + \delta_{12} \geq \delta_{05} + t_{55} + \delta_{56} + t_{66}$$

(not extract top drive Dolly until connection break out is done)

$t_{69} \geq t_{66}$(pipe handler moves pipe to fingerboard right after breaking out connection)

$$t_{11} + \delta_{12} \geq \delta_{08} + t_{88} + \delta_{89}$$

$$\left(\begin{array}{l}\text{not move pipe handler to fingerboard}\\ \text{until top drive Dolly starts retracting}\end{array}\right)$$

Note that $t_{77}$ in the T matrix and $Obj_{in}$ is only the duration of the iron roughneck retraction until the slips are removed for the next stand.

The above mathematical formulation may be used to also identify the equipment on critical path and optimize time difference between machinery movements. For example, $\delta_{12}$, the gap between tripping on elevators and removing the top drive dolly from well center, could be further reduced. Further optimization would require increasing machinery speed without surpassing mechanical limits.

Figure 5A:
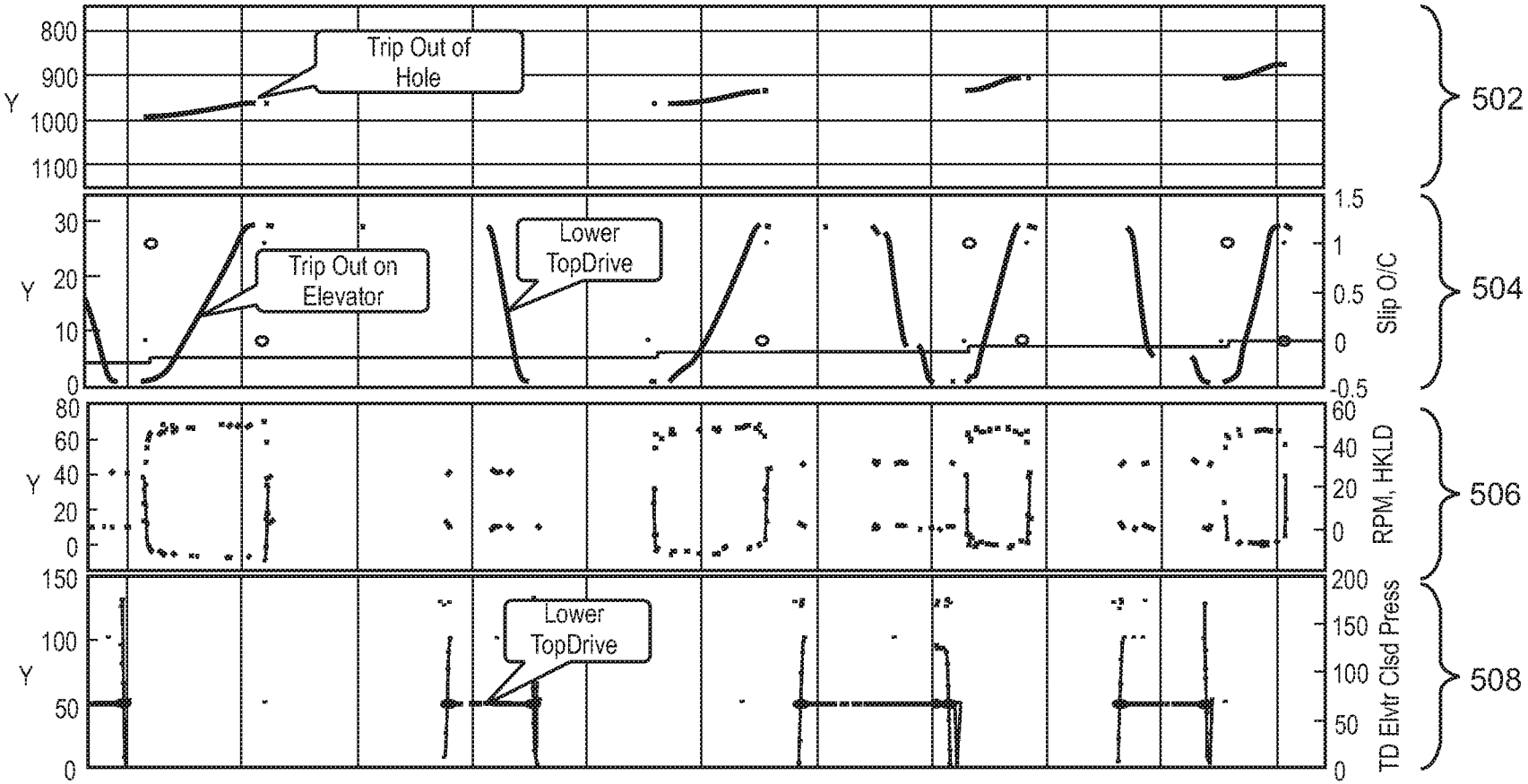
FIGS. 5A and 5B are drawings of a graphical representation of example equipment heights through the tripping process being optimized, in accordance with examples.
Figure 5B:
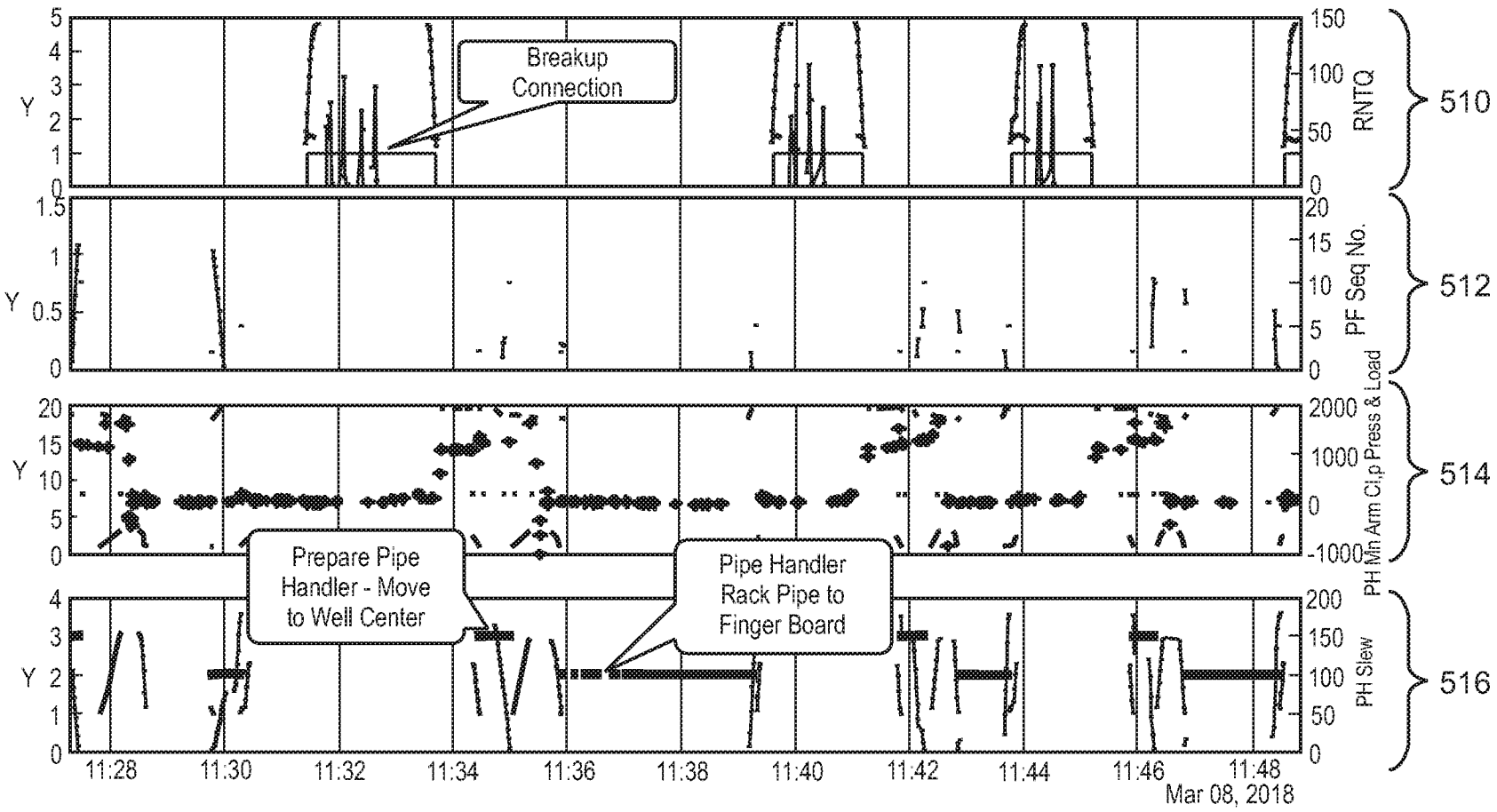

FIG. 5A and FIG. 5B are drawings of a graphical representation of example equipment heights through the tripping process being optimized. FIG. 5A and FIG. 5B display time on the x-axis and height or component activity on the y-axis. The time shown in this example show an example eight hour tripping in action into an already cased hole. The data shown graphically here may be data downloaded from an associated rig database. The four graphs seen in FIG. 5A are all related to the top drive operation, where BD is bit depth; hole depth (HD) is NaN since HD does not change during this time period recorded.

One graph 502 shown in FIG. 5A indicates the height of rig equipment over time as it trips out of the hole. Another graph 504 shows the height of components as they trip out of the elevator or the top drive is lowered. The circles in 504 present "Slip Open" i.e. slip off; while the dots are near the top of the graphed lines indicate a "Slip Close" action, i.e. slip on. As used herein, the slip is the name for the clamp in the floor the drilling rig that holds the pipe after it is released by other components. The ascending stair line indicates stand number lasting from slip-off to slip-off. The graphical representation 506 shown in FIG. 5A also show a component that activates and adjusts height to interact with the top drive as it starts and stops a trip on the elevator. The graphical representation 508 shown in FIG. 5A also shows a top drive elevator close press activating moving as a top drive is being lowered.

The graphical representation 510 shown in FIG. 5B show an iron roughneck breaking out a stand or pipe connection. This panel shows the signals from iron roughneck including arm position, e.g. high on the y-axis of 510=extension to the well center and low on the y-axis of 510=retrieve action. In 510, the dots marked along the lines indicate the arm position generally and the interceding lines indicate a torque value applied by the iron roughneck.

The graphical representation 512 shown in FIG. 5B relates to pipe handler operation specifically the pipe handler Sequence number. The graphical representation 514 shown in FIG. 5B show a pipe handler as it presses and loads pipes into position. The graphical representation 516 shown in FIG. 5B shows a pipe handler moving a pipe to a well center moving a pipe back to the fingerboard once the pipe is detached and movable. In 516, the channel shows a pipe handler slew angle where a measurement of 0° means that the pipe handler faces the fingerboard and a measurement of 180° means that the pipe handler has rotated to the well center.

Each of the graphical representations shown in FIG. 5A and FIG. 5B can show some of the data tracked by sensors of the rig equipment later used in optimizing the process to minimize tripping time.

The present techniques utilize the rig equipment data collected into a database. The data includes all time-based analog and discrete historical sensor data, while the event tables include the alarm event data. A number of data tags may also be added for additional sensor inputs on the rig equipment. For example, some systems may include three thousands data tags from which a subset may be used in determining and optimizing the timing of rig states. In an example, twenty six analog and discrete data tags may be used related to tripping and pipe handling for the proposed performance analytics.

Figure 6A:
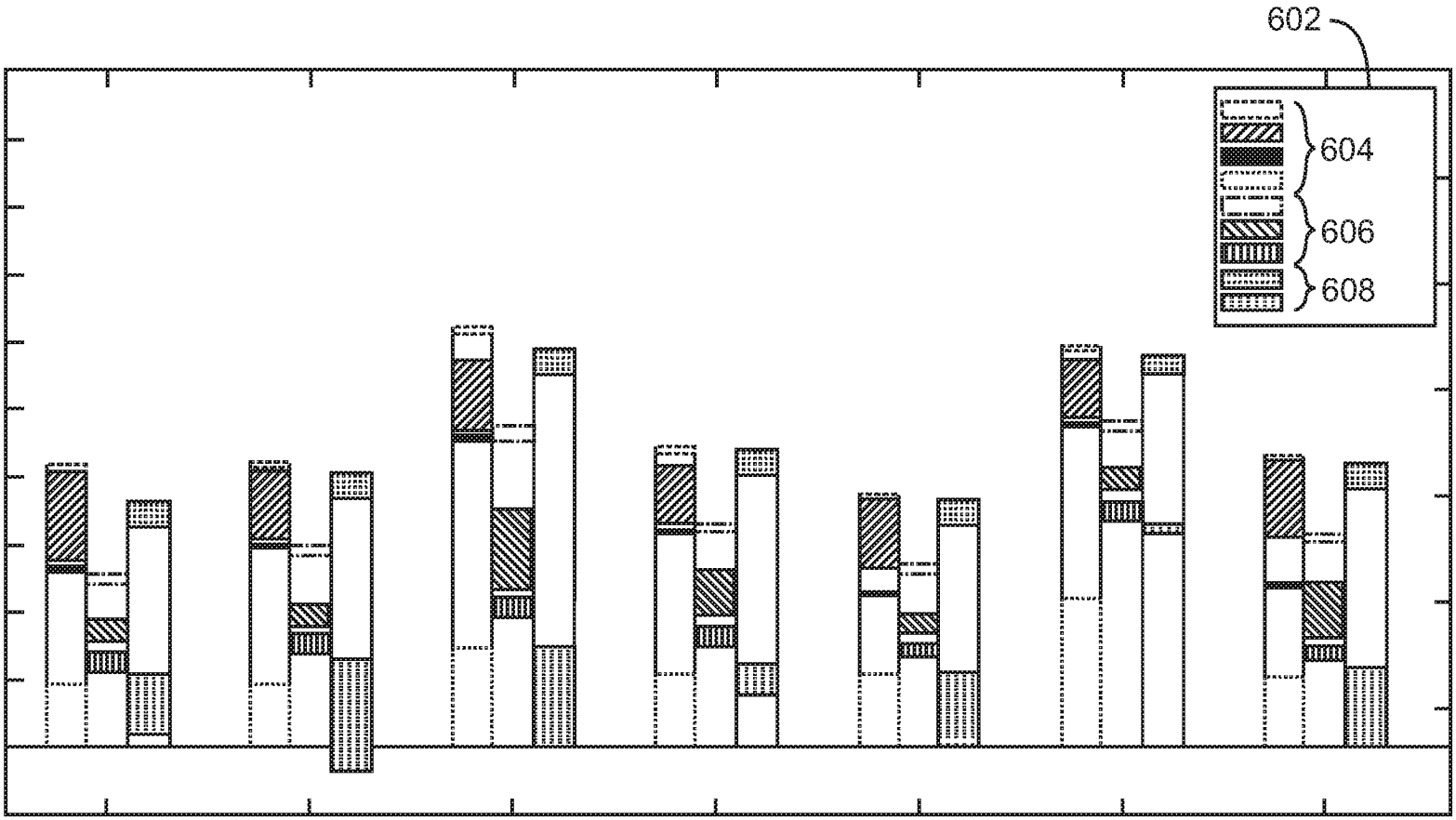
FIGS. 6A and 6B are drawings showing example graphical representations of tripping out times for a variety of equipment for a number of stands as well as statistical analysis of these times, in accordance with examples.
Figure 6B:
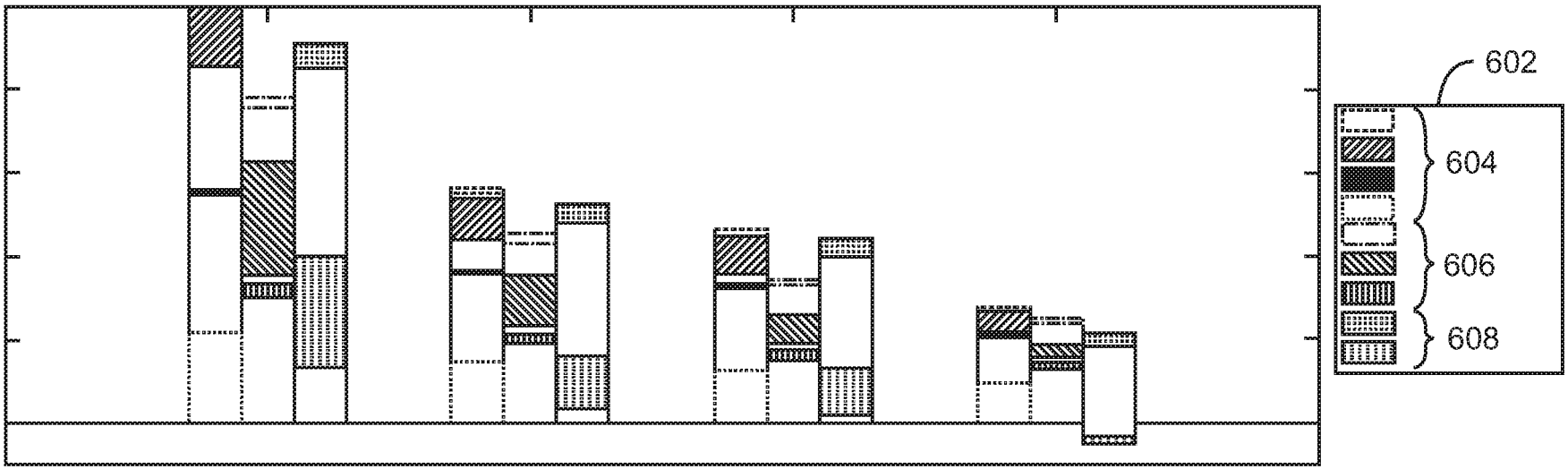

FIGS. 6A and 6B are drawings showing example graphical representations 600A and 600B of times for a single tripping out cycle for a variety of equipment for a number of stands as well as statistical analysis of these times. The shaded regions in these clusters indicate a component taking an action or actively moving to a specified position. The white a non-dashed border segments indicate time where a component may be inactive. In FIG. 6A the x-axis represents a different cluster of bars represent an example of how much time tripping out took for each stand. Each of the differently shaded portions corresponds to a different piece of rig equipment that can be identified on a legend 602. The ornamentally outlined or shaded regions shown can correspond to the top drive component 604, the iron roughneck component 606, or the pipe handler component 608. The graph in FIG. 6A shows the variety of tripping out times that are currently possible and how it can vary from one stand being tripped out to another. The graphs also show that this data that includes durations for each component completing its task. This information can be used to identify which components are taking longer or shorter depending on the particular tripping out that has occurred.

FIG. 6A shows the multi-thread rig state detection for every stand over a specified time duration for tripping out. For each stand, a group of three stacked bars indicates the time duration and sequence for the operation steps of the top drive 604, iron roughneck 606, and pipe handler 608. Included in the steps measured here, a first step may be tripping on elevator, e.g. pulling drill string out of the hole, which is done by the first stacked bar, i.e. top drive 604. Then the iron roughneck 606 breaks out the drill pipe connections as shown in the second stacked bar in a given cluster corresponding to that particular stand. After the pipe handler 608 captures the free stand, the top drive 604 detaches from the drill pipe. Once the pipe handler 608 has removed the stand from well center, the top drive 604 returns back to the lower position ready for pulling the next stand. The third stacked bar indicates the pipe handler 608 motion including capturing and racking the stand back to the fingerboard. In summary, iron roughneck 606 actions are in between tripping on elevator and returning top drive 604, and the critical path is determined by top drive 604 motion shown in the first stacked bar of each stand in this chart, referred to as a Gantt chart.

FIG. 6B shows some of the statistical analysis approaches that may be taken using the duration data that has been gathered. In an example, cluster 610 shows the worst combination of timings for each of the components from the example time measurements for tripping out the stands in FIG. 6A. In cluster 610, all the worst timings measured from a previous tripping out action for each separate component can be combined to show a worst possible time duration for a tripping out operation based on previously measured tripping cycles. Cluster 612 shows a mean combination of timings creative by taking the statistical mean of the time durations measured for each of the tripping cycles measured and shown in FIG. 6A. Cluster 614 shows a median combination of timings creative by taking the statistical median of the time durations measured for each of the tripping cycles measured and shown in FIG. 6A. In cluster 616, all the best timings measured from a previous tripping out action for each separate component can be combined to show a best measured time duration for a tripping out operation based on previously measured tripping cycles.

Figure 7A:
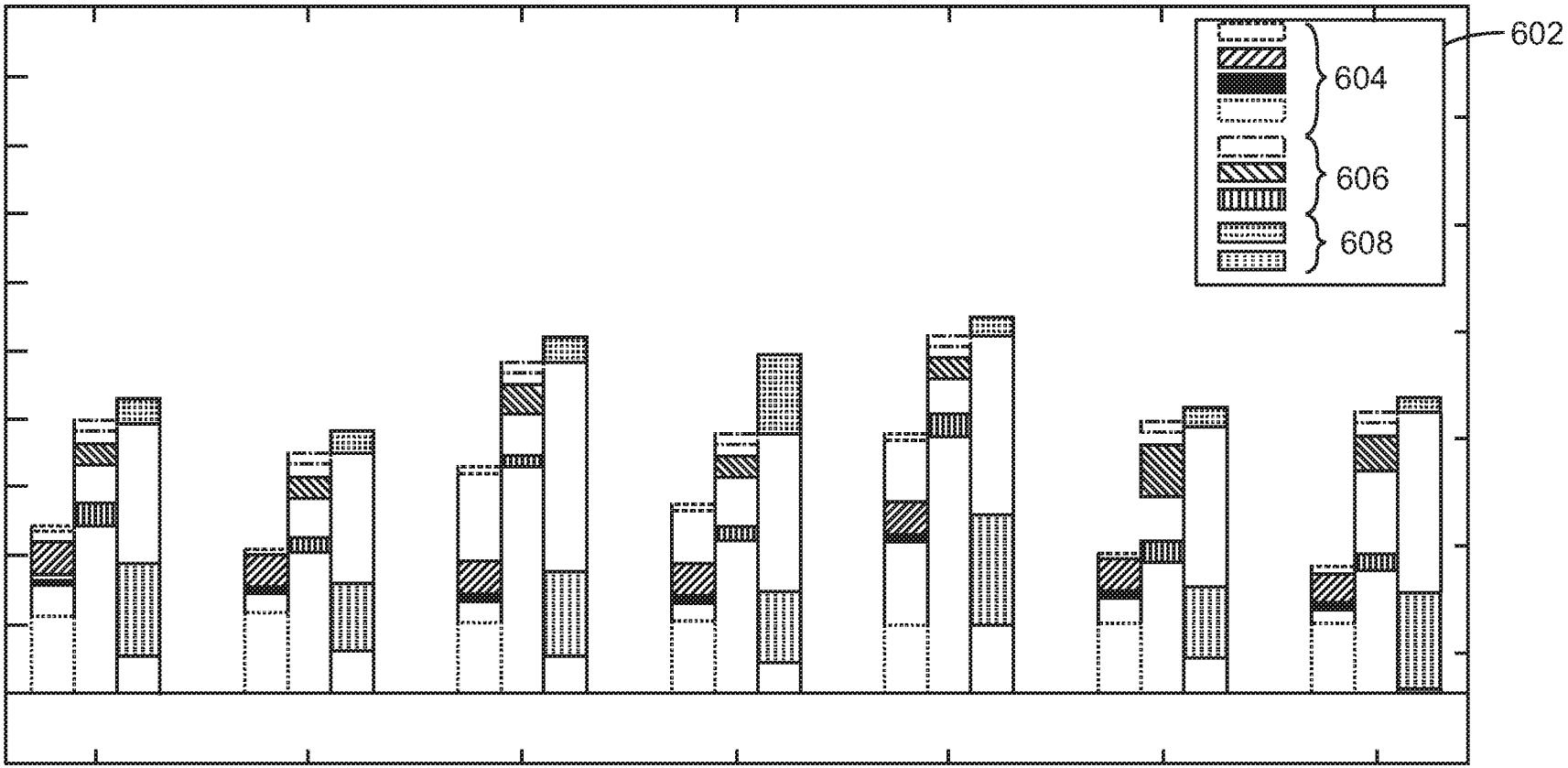
FIGS. 7A and 7B are drawings showing example graphical representations of tripping in times for a variety of equipment for a number of stands as well as statistical analysis of these times, in accordance with examples.
Figure 7B:
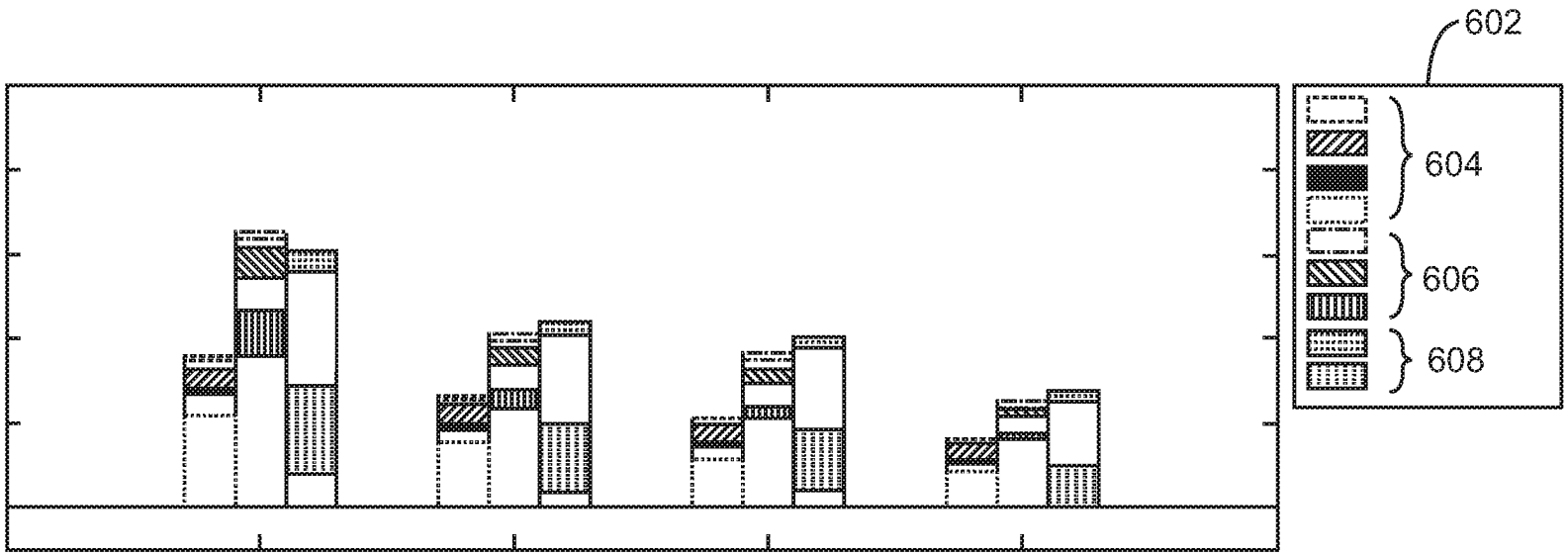

FIGS. 7A and 7B are drawings showing example graphical representations 700A and 700B of tripping in times for a variety of equipment for a number of stands as well as statistical analysis of these times. Like numbered items are as discussed with respect to FIGS. 6A and 6B.

FIG. 7A shows the multi-thread rig state detection for tripping in using the same conventions as FIG. 6A and FIG. 6B. The first step is the tripping on elevator or lowering a drill stand into the hole. Then the top drive 604 returns to the high position such that pipe handler 608 can add a new stand to the existing one. After that, the iron roughneck 606 makes up the connections as shown in the second stacked bar. The third stacked bar in each cluster indicates the pipe handler 608 motion including moving the new stand to the well center and returning back to the finger board. In summary, the iron roughneck 606 operates after the top drive 604 returns to its high position, and the critical path is determined by the iron roughneck 606 operation, since the top drive 604 operation is embedded as one of the constraints of the iron roughneck 606 operation.

FIG. 7B shows some of the statistical analysis approaches that may be taken using the duration data that has been gathered. In an example, cluster 610 shows the worst combination of timings for each of the components from the example tripping in measurements from the stands in FIG. 7A. In cluster 610, all the worst timings measured from a previous tripping in action for each separate component can be combined to show a worst possible time duration for a tripping in operation based on previously measured tripping cycles. Cluster 612 shows a mean combination of timings creative by taking the statistical mean of the time durations measured for each of the tripping cycles measured and shown in FIG. 6A. Cluster 614 shows a median combination of timings creative by taking the statistical median of the time durations measured for each of the tripping cycles measured and shown in FIG. 6A. In cluster 616, all the best timings measured from a previous tripping in action for each separate component can be combined to show a best measured time duration for a tripping in operation based on previously measured tripping cycles.

It should be understood that the preceding is merely a detailed description of specific embodiments of this invention and that numerous changes, modifications, and alternatives to the disclosed embodiments can be made in accordance with the disclosure here without departing from the scope of the invention. Rather, the scope of the invention is to be determined only by the appended claims and their equivalents.

What is claimed is:

1. A method of optimizing timing for drilling and tripping operation comprising:

receiving a plurality of sensor data characterizing rig equipment and tripping status;

identifying a plurality of multi-thread rig states based on the plurality of sensor data;

calculating a plurality of optimal rig state characteristics (RSCs), wherein the plurality of optimal RSCs includes at least one of an optimal duration of each potential next rig state, an optimal starting time of each potential next rig state, or an optimal time difference between any different of each potential next rig state for each stand, and wherein the plurality of optimal RSCs are calculated based on the plurality of sensor data as it relates to the plurality of multi-thread rig states;

performing a tripping operation with the rig equipment after applying the plurality of optimal RSCs; and gathering a plurality of updated sensor data from the rig equipment during the tripping operation for a recalculation of the plurality of optimal RSCs.

2. The method of claim 1, wherein identifying the optimal RSCs is based on historical locally generated sensor data for the rig equipment being optimized.

3. The method of claim 1, wherein performing a tripping operation with the rig equipment includes rig equipment that handles a tubular that comprises at least one of a drill string, casing, a completion assembly, or a standalone screen.

4. The method of claim 1, wherein the plurality of optimal RSCs are selected by at least one of a conditional-based table or a machine learning algorithm.

5. The method of claim 1, wherein calculating the plurality of optimal RSCs uses aggregated statistics relating to the plurality of sensor data measured for a plurality of stands tripped in using the rig equipment.

6. The method of claim 5, wherein the aggregated statistics comprise at least one of an average, standard deviation, variance, median, min, max, percentile, quintile, or histogram based on the plurality of sensor data for the plurality of stands tripped in using the rig equipment.

7. The method of claim 1, wherein calculating the plurality of optimal RSCs includes minimizing an objective function corresponding to a critical path identified from a subset of the plurality of multi-thread rig states.

8. The method of claim 7, wherein the selection of the critical path is based on at least one function executed by a top drive for tripping that is tripping out, or the critical path is based on at least one function executed by an iron roughneck for tripping in.

9. The method of claim 7, wherein identifying a critical path includes solving a scheduling optimization problem subject to constraints.

10. The method of claim 9, wherein the constraints are a time dependency of at least two of the plurality of multi-thread rig states, where each of the plurality of multi-thread rig states corresponds to a different piece of rig equipment.

11. A system for drilling a wellbore and/or tripping operation, comprising:

a top drive;

an iron roughneck;

a pipe handler;

a control system coupled to the top drive, iron roughneck, and pipe handler, wherein the control system comprises a processor; and a storage medium comprising computer readable instructions configured to direct the processor to:

receive a plurality of sensor data characterizing rig equipment and tripping status;

identify a plurality of multi-thread rig states based on the plurality of sensor data;

calculate a plurality of optimal rig state characteristics (RSCs), wherein the plurality of optimal RSCs includes at least one of an optimal duration of each potential next rig state, an optimal starting time of each potential next rig state, or an optimal time difference between any different of each potential next rig state for each stand, and wherein the plurality of optimal RSCs are calculated based on the plurality of sensor data as it relates to the plurality of multi-thread rig states;

perform a tripping operation with the rig equipment after applying the plurality of optimal RSCs; and gather a plurality of updated sensor data from the rig equipment during the tripping operation for a recalculation of the plurality of optimal RSCs.

12. The system of claim 11, wherein identifying the optimal RSCs is based on historical locally generated sensor data for the rig equipment being optimized.

13. The system of claim 11, wherein performing a tripping operation with the rig equipment includes rig equipment that handles a tubular that comprises at least one of a drill string, casing, a completion assembly, or a standalone screen.

14. The system of claim 11, wherein the plurality of optimal RSCs are selected by at least one of a conditional-based table or a machine learning algorithm.

15. The system of claim 11, wherein calculating the plurality of optimal RSCs uses aggregated statistics relating to the plurality of sensor data measured for a plurality of stands tripped in using the rig equipment.

16. The system of claim 15, wherein the aggregated statistics comprise at least one of an average, standard deviation, variance, median, min, max, percentile, quintile, or histogram based on the plurality of sensor data for the plurality of stands tripped in using the rig equipment.

17. The system of claim 11, wherein calculating the plurality of optimal RSCs includes minimizing an objective function corresponding to a critical path identified from a subset of the plurality of multi-thread rig states.

18. The system of claim 17, wherein the selection of the critical path is based on at least one function executed by a top drive for tripping that is tripping out, or the critical path is based on at least one function executed by an iron roughneck for tripping in.

19. The system of claim 17, wherein identifying a critical path includes solving a scheduling optimization problem subject to constraints.

20. The system of claim 19, wherein the constraints are a time dependency of at least two of the plurality of multi-thread rig states, where each of the plurality of multi-thread rig states corresponds to a different piece of rig equipment.

21. A non-transitory machine readable medium comprising instructions configured to direct a processor to:

receive a plurality of sensor data characterizing rig equipment and tripping status;

identify a plurality of multi-thread rig states based on the plurality of sensor data;

calculate a plurality of optimal rig state characteristics (RSCs), wherein the plurality of optimal RSCs includes at least one of an optimal duration of each potential next rig state, an optimal starting time of each potential next rig state, or an optimal time difference between any different of each potential next rig state for each stand, and wherein the plurality of optimal RSCs are calculated based on the plurality of sensor data as it relates to the plurality of multi-thread rig states;

perform a tripping operation with the rig equipment after applying the plurality of optimal RSCs; and gather a plurality of updated sensor data from the rig equipment during the tripping operation for a recalculation of the plurality of optimal RSCs.

22. The non-transitory machine readable medium of claim 21, wherein the plurality of optimal RSCs are selected by at least one of a conditional-based table or a machine learning algorithm.

23. The non-transitory machine readable medium of claim 21, wherein calculating the plurality of optimal RSCs uses aggregated statistics relating to the plurality of sensor data measured for a plurality of stands tripped in using the rig equipment.

24. The non-transitory machine readable medium of claim 23, wherein the aggregated statistics comprise at least one of an average, standard deviation, variance, median, min, max, percentile, quintile, or histogram based on the plurality of sensor data for the plurality of stands tripped in using the rig equipment.

25. The non-transitory machine readable medium of claim 21, wherein calculating the plurality of optimal RSCs includes minimizing an objective function corresponding to a critical path identified from a subset of the plurality of multi-thread rig states.

26. The non-transitory machine readable medium of claim 25, wherein the selection of the critical path is based on at least one function executed by a top drive for tripping that is tripping out, or the critical path is based on at least one function executed by an iron roughneck for tripping in.

27. The non-transitory machine readable medium of claim 25, wherein identifying a critical path includes solving a scheduling optimization problem subject to constraints.

28. The non-transitory machine readable medium of claim 27, wherein the constraints are a time dependency of at least two of the plurality of multi-thread rig states, where each of the plurality of multi-thread rig states corresponds to a different piece of rig equipment.

29. A method of optimizing timing for drilling and tripping operation comprising:

receiving a plurality of sensor data characterizing rig equipment and tripping status;

identifying a plurality of multi-thread rig states based on the plurality of sensor data;

calculating a plurality of optimal rig state characteristics (RSCs), wherein the plurality of optimal RSCs are calculated based on the plurality of sensor data as it relates to the plurality of multi-thread rig states, and wherein calculating the plurality of optimal RSCs includes minimizing an objective function corresponding to a critical path identified from a subset of the plurality of multi-thread rig states;

performing a tripping operation with the rig equipment after applying the plurality of optimal RSCs; and gathering a plurality of updated sensor data from the rig equipment during the tripping operation for a recalculation of the plurality of optimal RSCs.

30. A non-transitory machine readable medium comprising instructions configured to direct a processor to:

receive a plurality of sensor data characterizing rig equipment and tripping status;

identify a plurality of multi-thread rig states based on the plurality of sensor data;

calculate a plurality of optimal rig state characteristics (RSCs), wherein the plurality of optimal RSCs are calculated based on the plurality of sensor data as it relates to the plurality of multi-thread rig states, and wherein calculating the plurality of optimal RSCs includes minimizing an objective function corresponding to a critical path identified from a subset of the plurality of multi-thread rig states;

perform a tripping operation with the rig equipment after applying the plurality of optimal RSCs; and gather a plurality of updated sensor data from the rig equipment during the tripping operation for a recalculation of the plurality of optimal RSCs.

* * * * *